US009285170B2

(12) United States Patent
France et al.

(10) Patent No.: US 9,285,170 B2
(45) Date of Patent: Mar. 15, 2016

(54) HYBRID RADIATOR COOLING SYSTEM

(71) Applicant: UChicago Argonne, LLC, Chicago, IL (US)

(72) Inventors: David M. France, Lombard, IL (US); David S. Smith, Bartlett, IL (US); Wenhua Yu, Darien, IL (US); Jules L. Routbort, Willowbrook, IL (US)

(73) Assignee: UChicago Argonne, LLC, Chicago, IL (US)

( * ) Notice: Subject to any disclaimer, the term of this patent is extended or adjusted under 35 U.S.C. 154(b) by 474 days.

(21) Appl. No.: 13/775,904

(22) Filed: Feb. 25, 2013

(65) Prior Publication Data

US 2013/0233517 A1 Sep. 12, 2013

Related U.S. Application Data

(60) Provisional application No. 61/608,670, filed on Mar. 9, 2012.

(51) Int. Cl.
*F28D 1/00* (2006.01)
*B01F 3/04* (2006.01)

(52) U.S. Cl.
CPC .... *F28D 1/00* (2013.01); *B01F 3/04* (2013.01)

(58) Field of Classification Search
CPC ..... B01F 3/04; F28D 1/00
USPC ..... 261/110, 112.1, 112.2, 152, 153, 156; 165/104.21, 166
See application file for complete search history.

(56) References Cited

U.S. PATENT DOCUMENTS 4,272,462 A * 6/1981 Butt ..... F28D 5/02 165/166

* cited by examiner

*Primary Examiner* — Robert A Hopkins
(74) *Attorney, Agent, or Firm* — Joan Pennington

(57) ABSTRACT

A method and hybrid radiator-cooling apparatus for implementing enhanced radiator-cooling are provided. The hybrid radiator-cooling apparatus includes an air-side finned surface for air cooling; an elongated vertically extending surface extending outwardly from the air-side finned surface on a downstream air-side of the hybrid radiator; and a water supply for selectively providing evaporative cooling with water flow by gravity on the elongated vertically extending surface.

8 Claims, 8 Drawing Sheets

HYBRID RADIATOR COOLING SYSTEM

This application claims the benefit of U.S. Provisional Application No. 61/608,670 filed on Mar. 9, 2012.

CONTRACTUAL ORIGIN OF THE INVENTION

The United States Government has rights in this invention pursuant to Contract No. DE-AC02-06CH11357 between the United States Government and UChicago Argonne, LLC representing Argonne National Laboratory.

FIELD OF THE INVENTION

The present invention relates generally to a hybrid radiator-cooling system, and more particularly, relates to a method and hybrid radiator-cooling system for implementing enhanced radiator-cooling and reducing the size or increasing the cooling capacity of vehicle coolant radiators.

DESCRIPTION OF THE RELATED ART

Coolant radiators in trucks and automobiles are designed to transfer the maximum heat load at a designated design condition. An example design condition is a fully-loaded truck climbing up Baker Grade, a stretch of Interstate Highway 15 just east of Baker, Calif., on the hottest summer day. The coolant system including the radiator is sized to remove 100% of the required heat from the engine at the design condition without boiling the coolant, which results in a large radiator. This condition has two ramifications: first, the radiator is oversized under most driving conditions; and second, in cases where the maximum radiator size is limited by the vehicle frontal area, the engine power may be limited by the radiator size.

The dominant factor affecting the size of a coolant radiator is the heat transfer coefficient of the outside air flowing over it. If this coefficient were increased, the radiator size could be reduced, or more heat could be transferred from an existing radiator. The latter case would allow for increased engine power when it is limited by the radiator size.

The air-side fin designs of current radiators have been optimized to maximize the effective air-side heat transfer coefficient and heat transfer area. Typical louvered fins are of short fin lengths (close channel spacing) to maximize fin effectiveness. With the fin design at or near optimum, there is little more to be gained in terms of increasing the effective heat transfer coefficient from this aspect of the design.

A need exists for an enhanced hybrid radiator cooling apparatus. It is desirable to provide such a hybrid radiator cooling apparatus that enables enhanced radiator-cooling, for example, reducing the size or increasing the cooling capacity of vehicle coolant radiators.

SUMMARY OF THE INVENTION

Principal aspects of the present invention are to provide a method and hybrid radiator-cooling apparatus for modulating the size or the cooling capacity of vehicle coolant radiators. Other important aspects of the present invention are to provide such method and hybrid radiator-cooling apparatus substantially without negative effect and that overcome some of the disadvantages of prior art arrangements.

In brief, a method and hybrid radiator-cooling apparatus for implementing enhanced radiator-cooling are provided. The hybrid radiator-cooling apparatus includes an air-side finned surface for air cooling; an elongated vertically extending surface extending outwardly from the air-side finned surface; and a water supply for selectively providing evaporative cooling with water flow by gravity on the elongated vertically extending surface.

In accordance with features of the invention, the novel hybrid radiator-cooling apparatus provides cooling of the outside of a radiator using both finned air cooling and evaporative cooling at high heat loads on the engine, increasing the air-side heat transfer coefficient. The evaporative cooling is a more active heat transfer mechanism, and advantageously is used at a predefined thermal design condition for the coolant system. Under most driving conditions, only the more conventional finned air cooling is used to remove the required engine heat.

In accordance with features of the invention, a plurality of generally rectangular tubes or flattened tubes define a plurality of the elongated vertically extending surfaces extending outwardly from the air-side finned surface.

In accordance with features of the invention, applying the active evaporative cooling of the hybrid radiator-cooling apparatus allows for the reduction of the radiator size without a substantially large change from the optimized standard cooling system because, with the active evaporative cooling, the radiator can be designed based on the normal operating conditions instead of the peak heat load conditions.

BRIEF DESCRIPTION OF THE DRAWINGS

The present invention together with the above and other objects and advantages may best be understood from the following detailed description of the preferred embodiments of the invention illustrated in the drawings, wherein.

DETAILED DESCRIPTION OF THE PREFERRED EMBODIMENTS

In the following detailed description of embodiments of the invention, reference is made to the accompanying drawings, which illustrate example embodiments by which the invention may be practiced. It is to be understood that other embodiments may be utilized and structural changes may be made without departing from the scope of the invention.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

In accordance with features of the invention, a method and apparatus are provided for implementing enhanced radiator cooling for vehicle coolant radiators. Hybrid coolant radiators for use in vehicles, such as trucks, buses, and automobiles are provided for implementing enhanced radiator cooling including evaporative cooling.

Figure 1:
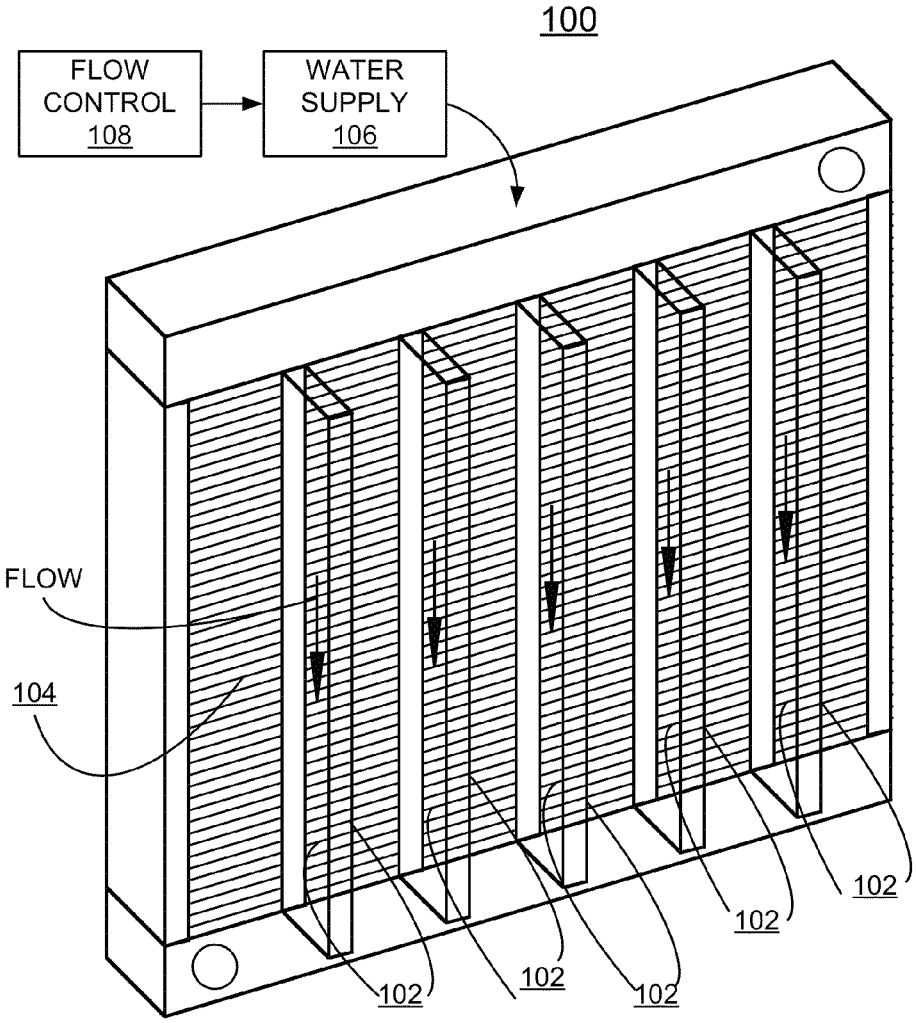
FIGS. 1 and 2 schematically illustrate an example hybrid radiator-cooling apparatus for implementing enhanced radiator-cooling and reducing the size or increasing the cooling capacity of vehicle coolant radiators in accordance with preferred embodiments.
Figure 2:
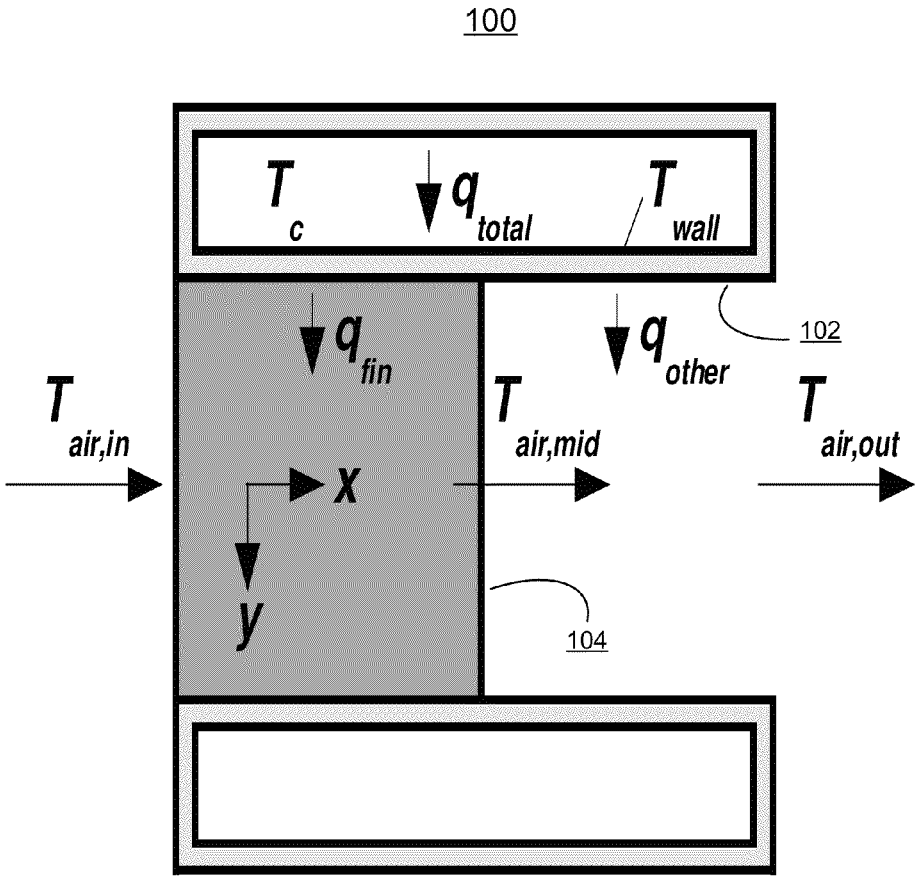
Figure 3:
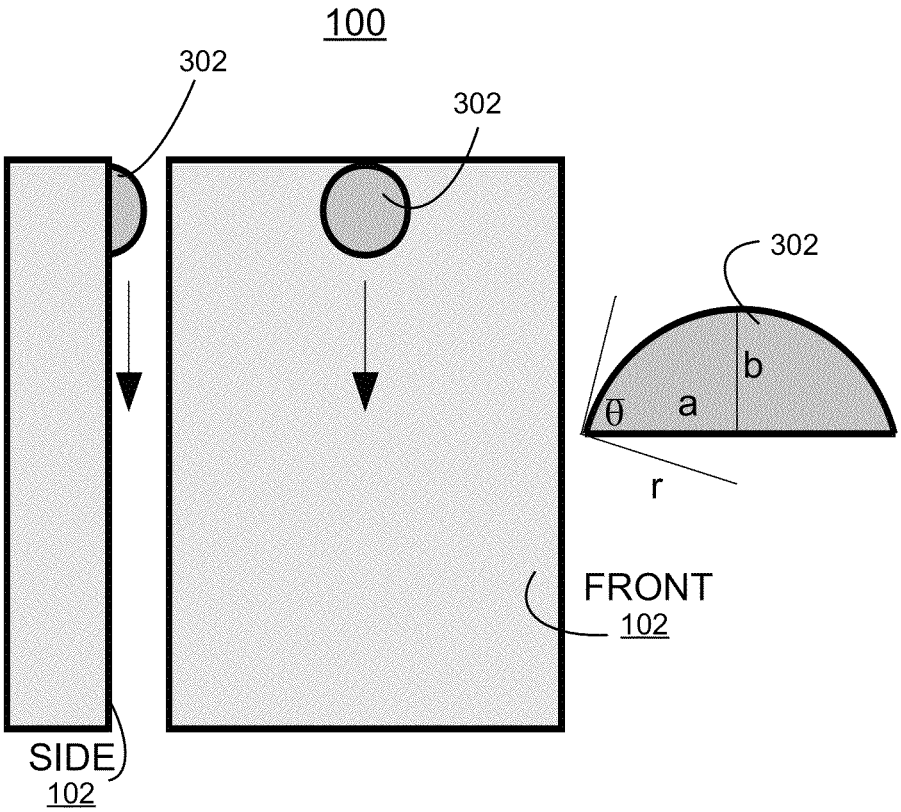
FIG. 3 schematically illustrates an example semispherical droplet falling along a vertical radiator surface of the example hybrid radiator-cooling apparatus of FIGS. 1 and 2 in accordance with a preferred embodiment.

Having reference now to the drawings, in FIGS. 1, 2, and 3 there is schematically shown an example hybrid radiator-cooling apparatus for implementing enhanced radiator-cooling, for example, for reducing the size or increasing the cooling capacity of vehicle coolant radiators generally designated by the reference character 100 in accordance with the preferred embodiment. Hybrid radiator-cooling apparatus 100 provides evaporative surface cooling in addition to the normal finned surface cooling for the most extreme driving conditions.

In accordance with features of the invention, hybrid radiator-cooling apparatus 100 provides evaporative cooling with a water flow having a small thickness from the radiator surfaces using water droplet flow with contact angle management. Hybrid radiator-cooling apparatus 100 provides a combination of conventional airside finned surface cooling and active evaporative water cooling.

Hybrid radiator-cooling apparatus 100 includes a plurality of elongated, vertically extending surfaces generally designated by the reference character 102 for evaporative cooling. The elongated, vertically extending surfaces 102 are carried by and extend outwardly from a conventional air finned cooling surface on a downstream air-side of the hybrid radiator generally designated by the reference character 104. The elongated, vertically extending surfaces 102 extend on downstream air-side of air finned cooling surface 104, substantially eliminating problems of saturating air with water vapor, allowing evaporative cooling at maximum efficiency, and adding to liquid stability on the extended tube surface 102. A water supply 106 operatively controlled by a flow control 108, selectively supplies evaporation water introduces at the top of the elongated, vertically extending surfaces 102 responsive to a predefined thermal design condition for the hybrid radiator-cooling apparatus 100. The water supply 106 selectively supplies evaporation water at a predefined high heat load on an engine.

Hybrid radiator-cooling apparatus 100 can be used with various evaporative cooling mechanisms including liquid films, liquid drops, and sprays that have been studied for various applications. Both liquid films and liquid drops have been analyzed for gravity flow, such as indicated by arrows labeled FLOW in FIG. 1, along the extended surfaces 102 or radiator coolant channels 102, for example, as shown in FIGS. 1, and 2. It should be understood that the geometry for the hybrid radiator-cooling system 100 can be varied and the present invention is not limited to the illustrated arrangement of hybrid radiator-cooling apparatus 100.

In accordance with features of the invention, the elongated, vertically extending surfaces 102 are area optimized for providing surface area adequate for complete water evaporation, and for providing surface area adequate for use with a small, predefined water supply source, such as a 76 liter water supply source.

FIG. 2 shows schematically a top view of a section of the example radiator-cooling apparatus 100 including the vertically extending surfaces 102 or vertical coolant channels 102, and the fins 104 between the vertical coolant channels indicated by the shaded area on the air side. The channels 102 are extended beyond the fins 104 on the downstream air side of the radiator as shown. These extended channel surfaces 102 are to be cooled by evaporating water flowing downwards by gravity into the plane of FIG. 2.

In accordance with features of the invention, the elongated, vertically extending surfaces 102 preferably are flattened vertical tubes rather than circular, and are extended on the downstream air-side of the radiator. The evaporation water is introduced at the top of the tubes defining the elongated, vertically extending surfaces 102, flowing downwardly by gravity and fully evaporating before reaching the bottom of the tubes. Complete evaporation is not required, but is economical. The evaporating water preferable is in the form of drops, while it should be understood that the evaporating water optionally may be in the form of a liquid film or other flow regime.

The combination of the conventional cooling from the finned surfaces 104 and the evaporative cooling from the extended channel surfaces 102 is the total heat transfer from the radiator to the atmosphere. Under the thermal design condition, both cooling mechanisms would be functioning. However, at most thermal loads below the design condition, only the conventional air-side finned surface cooling would be required. Thus, the active cooling of the water evaporation would be used only at or very near the thermal design condition.

This limited use, of the active evaporative cooling component 102 of the hybrid radiator-cooling system 100 is important because evaporative cooling requires a supply of water. Using evaporative cooling only at or very near a predefined thermal design condition serves to optimize the parameters of reduced radiator size, or increased maximum radiator heat transfer, and minimized water use or transport. In the results presented below, an example is given of a hybrid radiator-cooling system 100 with a reduced sized radiator being capable of rejecting all required engine heat under all driving conditions except for rare desert conditions like Baker grade. Under such exceptional driving conditions, the evaporative cooling component 102 of the system would be used in addition to the conventional air-side finned channel heat transfer of the finned surfaces 104.

Referring also to FIG. 3, a semispherical droplet 302 is schematically shown falling along a vertical surface 102, such as illustrated in a side and front view of the surface 102. The droplet will wet the radiator surface and spread out as it flows downwards along the surface. Since aluminum and water have a contact angle that can vary with surface treatment (~90° for normal aluminum), it is assumed that the droplet forms a portion of a sphere that has been cut by a plane as shown in FIG. 3. While the actual shape will be more distorted on the lower portion due to gravity, the average thickness of the droplet, the most important parameter for determining the evaporation rate, will be similar in magnitude. The volume of the droplet after contact with the surface would then be the same as that of a spherical cap, where the cap base radius a and the cap height b can be calculated from the radius r of the sphere and the contact angle θ, as shown and described, for example, with respect to equations 23, 24 and 25 below.

In accordance with features of the invention, it will be shown that evaporative cooling is an excellent means of heat transfer and can have a significant effect on the radiator size or the maximum radiator thermal load. Importantly, the water supply necessary to accomplish this hybrid radiator cooling is reasonable and does not represent any significant technology barrier. Also the added weight of water is only encountered during exceptional driving conditions and will be partially compensated by the reduced radiator size and weight. It will be shown that adding evaporative cooling, without changing the finned surface area, can increase the heat transfer rate up to 46% for reasonable water flow rates and water usage amount.

Having reference to FIGS. 4-8, example operation of the hybrid radiator-cooling system 100 may be understood. The geometry and characteristics of the radiator, engine, and coolant pump were determined from a generic Cummins class 8 500-hp diesel truck engine. The radiator dimensions are detailed in the following Table 1. The heat removal rate in the radiator and the pump flow rate as a function of the engine rotating speed are given in Table 2. The radiator heat removal rate provided by Cummins Engine, Inc. for various coolant and air flow rates is given in Table 3. Heat transfer relationships for the air-side cooling in the louvered fin geometry were developed based on these data. Where the following Nomenclature, Greek symbols, and Subscripts are used:

Nomenclature

A contact area for droplet
a base radius of droplet cap
b height of droplet cap
$c_p$ mass-specific heat capacity
d diameter of circular hole
$D_h$ hydraulic diameter
g gravitational acceleration
h heat transfer coefficient
$i_{fg}$ latent heat of evaporation
k thermal conductivity
L length of slot hole
$L_{eff}$ effective length
m mass
$\dot{m}$ mass flow rate
$\dot{q}$ heat transfer rate
$\dot{q}''$ heat flux
r radius of droplet
Re Reynolds number
T temperature
t time
u velocity
V volume of droplet
W width of slot hole
x coordinate direction pointing from front to back
y coordinate direction pointing from wall to air
z coordinate direction pointing from top to bottom Greek Symbols α ratio of center length to end radius of elongated droplet
δ thickness
ΔA wall contact area
ϵ effectiveness
Γ mass flow rate per unit depth
γ surface tension
μ viscosity
θ contact angle
ρ density Subscripts air air
c coolant
d droplet
eva evaporation
ext extended region
fin finned region
in inlet
mid middle
other other
out outlet
sur surface
total total
w water
wall wall

TABLE 1

Radiator dimensions

| | | | |
|---|---|---|---|
| Total width (mm) | 988 | Fin spacing (#/m) | 630 |
| Total height (mm) | 564 | Fin thickness (mm) | 0.2 |
| Fin depth (mm) | 52 | Coolant channel area ($mm^2$) | 71.2 |
| Total depth (mm) | 72 | Coolant channel width (mm) | 1 |
| # of coolant Passages | 98 | Total flow area on air side ($m^2$) | 0.39 |
| Fin width (mm) | 8 | Total finned surface area on air side ($m^2$) | 31.8 |

TABLE 2

Radiator heat rejection and pump flow rate as a function of engine rotating speed under full throttle condition

| Engine speed (rpm) | Pump flow (L/min) | Radiator heat rejection (kW) |
|---|---|---|
| 1200 | 290 | 175.9 |
| 1300 | 314 | 187.8 |
| 1400 | 339 | 198.8 |
| 1500 | 365 | 213.3 |
| 1600 | 390 | 214.5 |
| 1700 | 415 | 221.8 |
| 1800 | 440 | 232.3 |
| 1900 | 465 | 235.3 |
| 2000 | 490 | 242.6 |

TABLE 3

Radiator heat removal rate as a function of air and coolant flow rates provided by Cummins

| | Coolant flow rate (kg/s) | | | |
|---|---|---|---|---|
| Air flow rate (kg/s) | 1.84 Heat transfer rate (kW) | 2.76 Heat transfer rate (kW) | 3.68 Heat transfer rate (kW) | 5.51 Heat transfer rate (kW) |
| 1.72 | 61.7 | 63.3 | 64.2 | 64.8 |
| 2.57 | 85.2 | 89.9 | 92.0 | 94.2 |
| 3.42 | 103.9 | 110.6 | 114.5 | 118.9 |
| 4.28 | 120.0 | 130.7 | 136.3 | 142.9 |

TABLE 3-continued

Radiator heat removal rate as a function of air and coolant flow rates provided by Cummins

| | Coolant flow rate (kg/s) | | | |
|---|---|---|---|---|
| Air flow rate (kg/s) | 1.84 Heat transfer rate (kW) | 2.76 Heat transfer rate (kW) | 3.68 Heat transfer rate (kW) | 5.51 Heat transfer rate (kW) |
| 5.15 | 133.4 | 146.3 | 153.7 | 162.0 |
| 6.00 | 145.1 | 160.9 | 170.3 | 181.1 |

Figure 4:
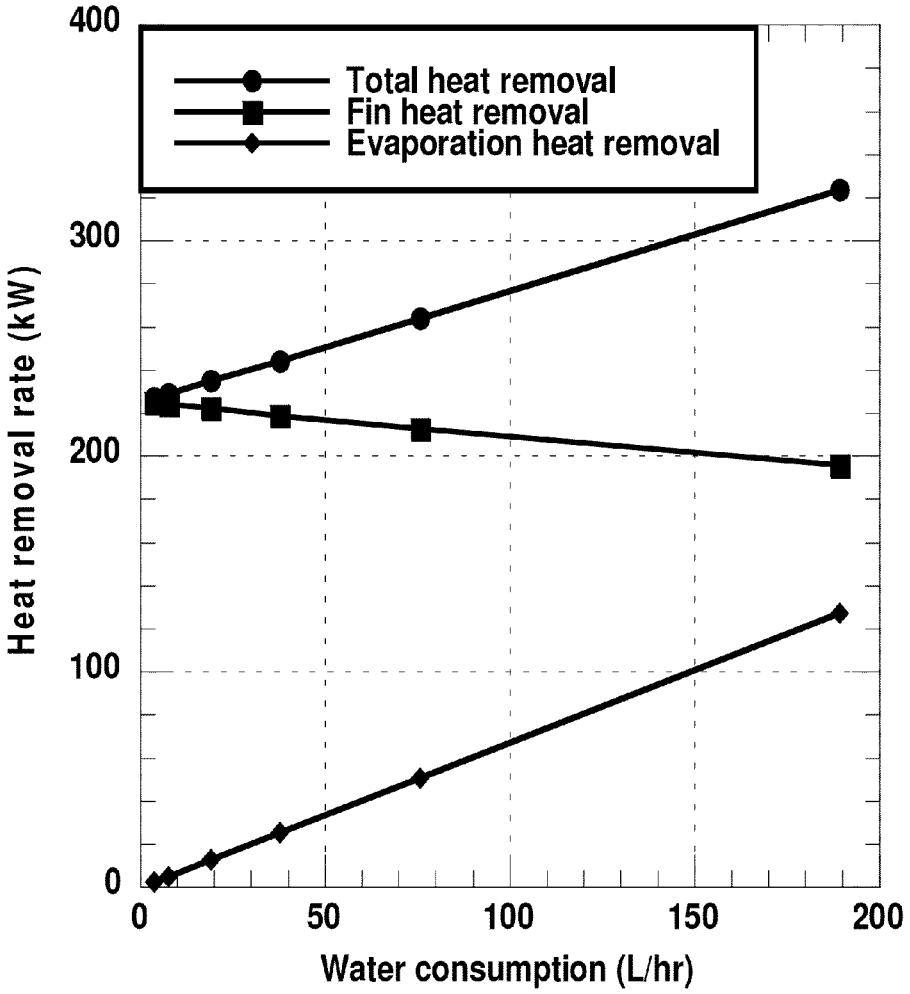
FIG. 4 illustrates example heat removal including total heat removal rate, fin heat removal and evaporation heat removal relative to water consumption with heat removal rate (kW) shown relative the vertical axis and water consumption (L/hr) shown relative the horizontal axis in accordance with preferred embodiments.

FIG. 4 illustrates heat removal including total heat removal rate, fin heat removal and evaporation heat removal relative to water consumption with heat removal rate (kW) shown relative the vertical axis and water consumption (L/hr) shown relative the horizontal axis in accordance with preferred embodiments.

Figure 5:
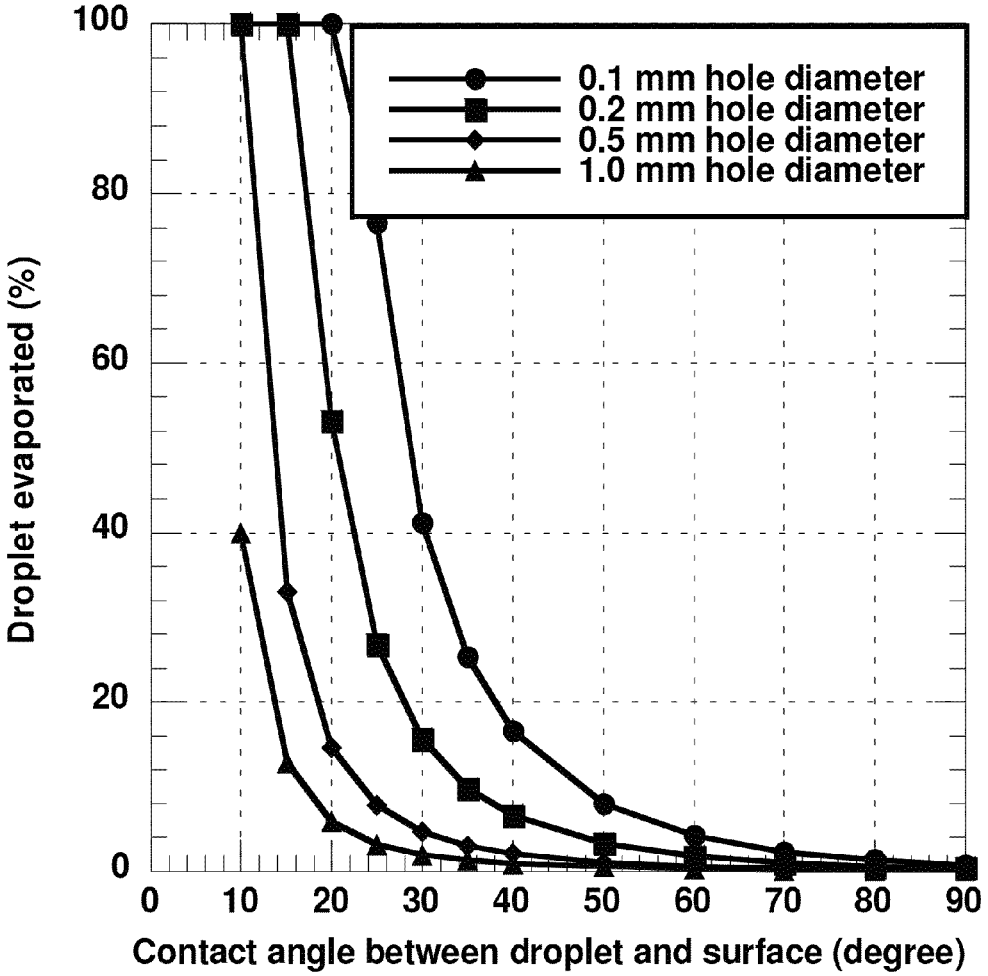
FIG. 5 illustrates example droplet evaporation including multiple hole diameters with droplet evaporation (%) shown relative the vertical axis and contact angle between droplet and surface (degree) shown relative the horizontal axis in accordance with preferred embodiments.

FIG. 5 illustrates example droplet evaporation including multiple hole diameters with droplet evaporation (%) shown relative the vertical axis and contact angle between droplet and surface (degree) shown relative the horizontal axis in accordance with preferred embodiments.

Figure 6:
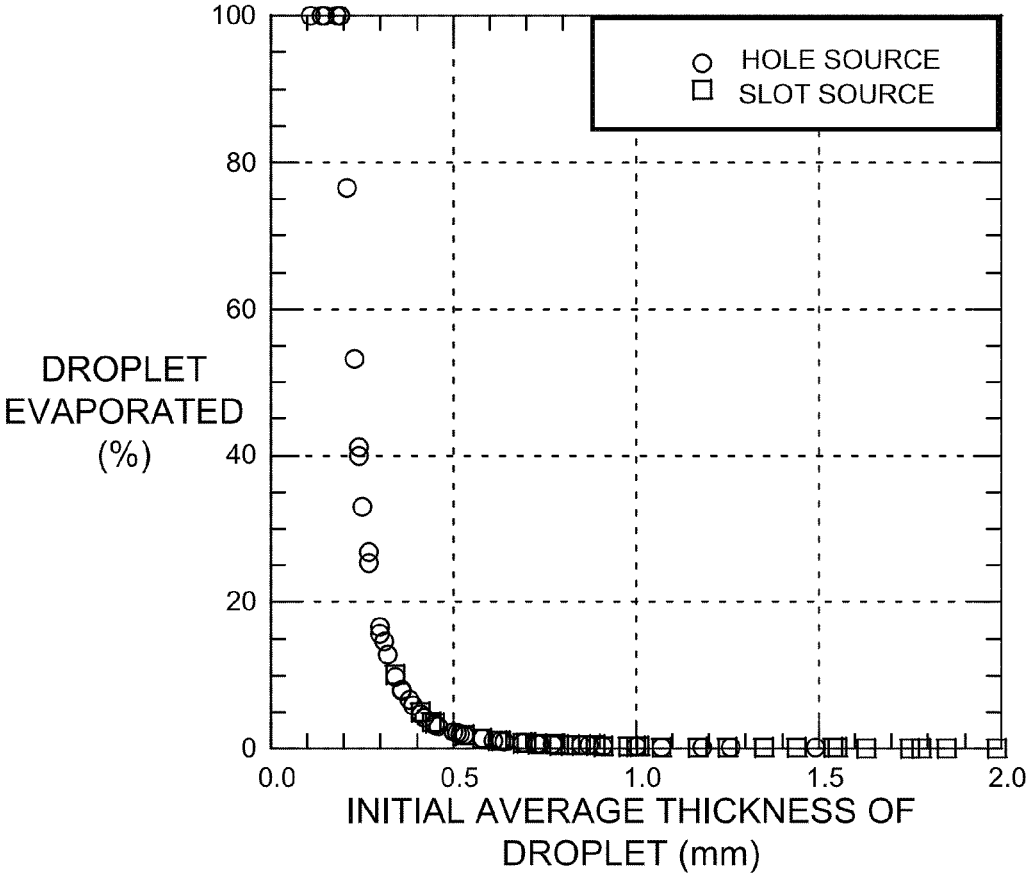
FIG. 6 illustrates example droplet evaporation at bottom of the radiator as a function of initial droplet thickness at the top of the radiator whether supplied from a hole or a slot in accordance with preferred embodiments.

FIG. 6 illustrates example droplet evaporation at bottom of the radiator as a function of initial droplet thickness at the top of the radiator whether supplied from a hole or a slot in accordance with preferred embodiments.

Figure 7:
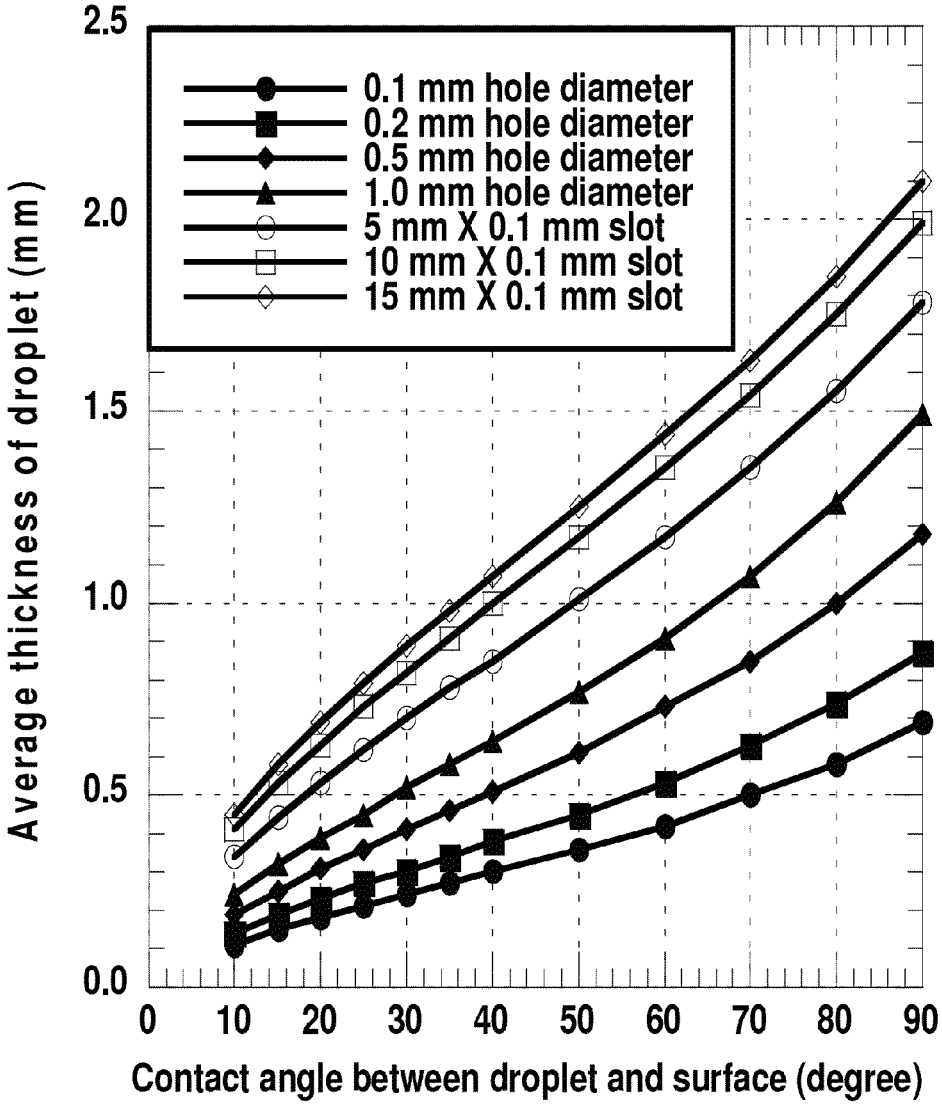
FIG. 7 illustrates example design of hole or slot including multiple hole diameters and multiple slot dimensions with average thickness of droplet (mm) shown relative the vertical axis and contact angle between droplet and surface (degree) shown relative the horizontal axis in accordance with preferred embodiments.

FIG. 7 illustrates design of hole or slot including multiple hole diameters and multiple slot dimensions with average thickness of droplet (mm) shown relative the vertical axis and contact angle between droplet and surface (degree) shown relative the horizontal axis in accordance with preferred embodiments.

Figure 8:
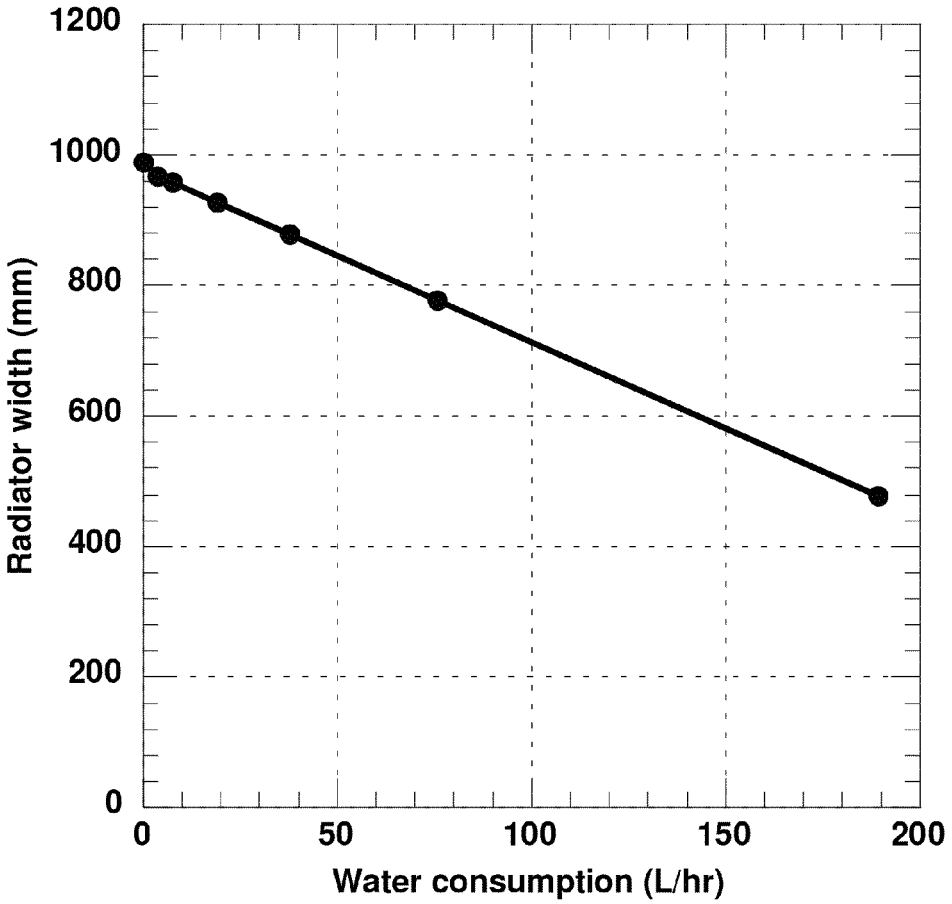
FIG. 8 illustrates example reduction in radiator size at fixed heat transfer relative to water consumption with radiator width (mm) shown relative the vertical axis and water consumption (L/hr) shown relative the horizontal axis in accordance with preferred embodiments.

FIG. 8 illustrates reduction in radiator size at fixed heat transfer relative to water consumption with radiator width (mm) shown relative the vertical axis and water consumption (L/hr) shown relative the horizontal axis in accordance with preferred embodiment.

Example Analyses

For heat transfer increases, three cases were studied for the geometry of FIGS. 1 and 2 and the dimensions from Table 1. The first case analyzed the increased heat transfer benefits of utilizing evaporating water in the form of a continuous falling film on the extended coolant channel surfaces of the radiator by comparing it to the radiator without evaporative cooling. The second and third cases involved discrete water droplets falling by gravity on the extended channel surfaces in the form of semispherical and elongated droplets, respectively, which focused on the percentage of evaporation from the given dimensions and contact angles of the droplets. The final part of this study analyzed the potential of the decrease in radiator size with the addition of evaporative cooling.

Example Evaporative Cooling from Falling Film (Case 1)

The local heat transfer coefficient, evaporation rate, film thickness, and film velocity for a continuous falling film flowing downwards along the extended channel surface shown in FIGS. 1 and 2 can be determined by the classical Nusselt solution through analogy between condensation and evaporation. The film thickness δ at a given position z is determined as a function of the density ρ and the viscosity μ from a force balance between gravity and the viscous forces at the wall.

$$\delta = \left[\frac{3\mu_w\Gamma_w}{\rho_w(\rho_w - \rho_{air})g}\right]^{1/3} \tag{1}$$

where the mass flow rate per unit depth $\Gamma_w$, an important parameter in determining evaporation, is a function of the film thickness δ and the average water velocity $\bar{u}$.

$$\Gamma_w = \rho_w \bar{u}_w \delta \tag{2}$$

The rate of heat transfer from the wall to liquid surface is controlled by conduction through the liquid film and can be calculated by assuming the water vapor at the water/air interface being at a saturated state with the same temperature as the air.

$$\begin{aligned} \dot{q}'' &= k_w \frac{dT}{dy} \\ &= k_w \frac{T_{wall} - T_{sur}}{\delta} \\ &= h_w(T_{wall} - T_{air}) \end{aligned} \tag{3}$$

The fluid flow behavior of the film as it flows downwards along the extended channel surfaces can be characterized through its Reynolds number.

$$\begin{aligned} Re &= \frac{\rho_w \bar{u}_w D_h}{\mu_w} \\ &= \frac{4\rho_w \bar{u}_w \delta}{\mu_w} \\ &= \frac{4\Gamma_w}{\mu_w} \end{aligned} \tag{4}$$

The liquid flow is laminar, laminar wavy, and turbulent for the Reynolds number in the ranges of Re<30, 30<Re<1800, and 1800<Re, respectively. Combining the above equations yields the classical Nusselt solution for heat transfer through a gravity-controlled laminar falling film with the Reynolds number of Re<30

$$\begin{aligned} \frac{h_w}{k_w}\left[\frac{\mu_w^2}{\rho_w(\rho_w - \rho_{air})g}\right]^{1/3} &= \left(\frac{4}{3Re}\right)^{1/3} \\ &= \frac{1.10}{Re^{1/3}} \end{aligned} \tag{5}$$

When the Reynolds number is in the range of 30<Re<1800, waves appear on the surfaces causing enhanced heat transfer. To account for this enhancement, an empirical factor $0.8(Re/4)^{0.11}$ is used, which results in:

$$\begin{aligned} \frac{h_w}{k_w}\left[\frac{\mu_w^2}{\rho_w(\rho_w - \rho_{air})g}\right]^{1/3} &= 0.8\left(\frac{Re}{4}\right)^{0.11}\left(\frac{4}{3Re}\right)^{1/3} \\ &\approx \frac{0.756}{Re^{0.22}} \end{aligned} \tag{6}$$

None of the flow rates in this study is in the turbulent region with the Reynolds number of 1800<Re where additional empirical correlations have been developed.[8] The mass flow rate decreases as a function of its vertical position due to the heat transferred from the wall evaporating liquid resulting in:

$$\frac{\Delta\Gamma_m}{\Delta z} = -\frac{h_w(T_{wall} - T_{air})}{i_{fg}} \tag{7}$$

Example Parallel Fin and Evaporative Cooling

The total heat transfer rate leaving the coolant at a given height z is the sum of the heat transfer rates entering the air through the finned portion and the extended portion of the coolant channel surfaces.

$$\dot{q}_{total}(z)=\dot{q}_{fin}(z)+\dot{q}_{ext}(z) \tag{8}$$

In Eq. (8), the total heat transfer rate leaving the coolant $\dot{q}_{total}$ can be expressed as a function of the vertical temperature change in the coolant by the energy balance on the coolant side.

$$\dot{q}_{total}(z)=\dot{m}_c c_{pc}[T_c(z)-T_c(z+dz)] \tag{9}$$

or as a function of the temperature difference between the coolant and the wall in terms of thermal resistances.

$$\dot{q}_{total}(z)=h_c\Delta A_c[T_c(z)-T_{wall}(z)] \tag{10}$$

In obtaining Eq. (10), $T_{wall}$ was assumed to be a function of the height z only because the thermal resistance in the aluminum is small.

The heat transfer rate entering the air from the finned portion of the coolant channel surfaces $\dot{q}_{fin}$ can be expressed as a function of the air temperature rise by the energy balance on the air side.

$$\dot{q}_{fin}(z)=\dot{m}_{air}c_{pair}(z)[T_{air,mid}(z)-T_{air,in}] \tag{11}$$

or as a function of the temperature difference between the wall and the air in terms of thermal resistances.

$$\dot{q}_{fin}=\epsilon_{fin}\dot{m}_{air}c_{pair}[T_{wall}(z)-T_{air,in}] \tag{12}$$

where the effectiveness $\epsilon_{fin}$ of the finned portion of the coolant channel surfaces at a given height z can be calculated by using the number of transfer units (NTU) method assuming that the temperature of the wall is constant along the airflow in the x direction.

$$\varepsilon_{fin} = 1 - e^{\frac{h_{air,fin}\Delta A_{fin}}{\dot{m}_{air}c_{pair}}} \tag{13}$$

When cooled only by convection to the air, the heat transfer rate entering the air from the extended portion of the coolant channel surfaces $\dot{q}_{ext}$ can be expressed as a function of the air temperature rise by the energy balance on the air side.

$$\dot{q}_{ext}(z)=\dot{m}_{air}c_{pair}[T_{air,out}(z)-T_{air,mid}(z)] \tag{14}$$

or, similar to the finned portion, as a function of the temperature difference between the wall and the air in terms of thermal resistances.

$$\dot{q}_{ext}=\epsilon_{ext}\dot{m}_{air}c_{pair}[T_{wall}(z)-T_{air,mid}(z)] \tag{15}$$

where the effectiveness of the extended portion of the coolant channel surfaces can be calculated by using the NTU method.

$$\varepsilon_{ext} = 1 - e^{\frac{h_{air,ext}\Delta A_{ext}}{\dot{m}_{air}c_{pair}}} \tag{16}$$

When evaporation occurs on the extended portion of coolant channel surfaces, the heat transfer is governed by the latent heat of evaporation given by:

$$\dot{q}_{ext}(z)=\dot{m}_{eva}(z)i_{fg} \tag{17}$$

which can be expressed as a function of the evaporation heat transfer coefficient and the temperature difference between the wall and the air.

$$\dot{q}_{ext}(z)=h_{eva}\Delta A_{ext}[T_{wall}(z)-T_{air,mid}(z)] \tag{18}$$

By combining the finned portion equations, the transition air temperature (the midpoint air temperature that exits the finned region and enters the extended channel region) can be related to the other temperatures.

$$T_{air,mid}(z)=T_{air,in}+\epsilon_{fin}[T_{wall}(z)-T_{air,in}] \tag{19}$$

The wall temperature of the radiator can be found by combining all the energy balance equations.

$$T_{wall}(z) = \frac{h_c\Delta A_c T_c(z) + [\varepsilon_{fin} + \varepsilon_{ext}(1 - \varepsilon_{fin})]\dot{m}_{air}c_{pair}T_{air,in}}{h_c\Delta A_c + [\varepsilon_{fin} + \varepsilon_{ext}(1 - \varepsilon_{fin})]\dot{m}_{air}c_{pair}} \tag{20}$$

when controlled only by convection to the air or $$T_{wall}(z) = \frac{h_c\Delta A_c T_c(z) + [\varepsilon_{fin}\dot{m}_{air}c_{pair} + (1 - \varepsilon_{fin})h_{eva}\Delta A_{ext}]T_{air,in}}{h_c\Delta A_c + \varepsilon_{fin}\dot{m}_{air}c_{pair} + (1 - \varepsilon_{fin})h_{eva}\Delta A_{ext}} \tag{21}$$

when controlled by evaporation to the air. This wall temperature $T_{wall}$ is valid as long as the air exiting the hybrid radiator is not saturated with water vapor, and the evaporation heat transfer coefficient $h_{eva}$ can be calculated from the heat transfer coefficient developed from the classical Nusselt solution. Because the temperature of the air is increased dramatically as it passes over the fins, the exit humidity of the air was never close to saturation for all of the cases analyzed in this study.

Example Evaporative Cooling from Semispherical Droplets (Case 2)

As alternatives to the falling film evaporative cooling on the extended coolant channel surfaces described above, two types of individual droplet evaporative cooling were analyzed, both flowing by gravity along the extended channel surfaces. The first type is semispherical droplets formed from circular holes (Case 2) and the second type is cylindrical droplets formed from slot-shape holes (Case 3).

For case 2, it is assumed that a water droplet is formed by liquid passing through a circular hole in the cooling system above the radiator. Because the water droplet falls from the source hole when gravity acting on the droplet is equal to the force due to the surface tension γ acting on the perimeter, the volume of the droplet V can be obtained from the balance of the two forces.

$$V = \frac{m_d}{\rho_w} = \frac{\pi\gamma d}{g\rho_w} \tag{22}$$

The droplet will wet the radiator surface and spread out as it flows downwards along the surface 102. Since aluminum and water have a contact angle that can vary with surface treatment (~90° for normal aluminum), it is assumed that the droplet forms a portion of a sphere that has been cut by a plane as shown in FIG. 3. While the actual shape will be more distorted on the lower portion due to gravity, the average thickness of the droplet, the most important parameter for determining the evaporation rate, will be similar in magnitude. The volume of the droplet after contact with the surface would then be the same as that of a spherical cap.

$$V = \frac{\pi}{6}(3a^2 + b^2)b \tag{23}$$

where the cap base radius a and the cap height b can be calculated from the radius r of the sphere and the contact angle θ of the cap.

$$a = r\sin\theta \tag{24}$$

$$b = r(1-\cos\theta) \tag{25}$$

Substituting these two results into the volume equation, Eq. (23), produces a relation for the radius of the sphere.

$$r = \sqrt[3]{\frac{3V}{\pi(2 - 3\cos\theta + \cos^3\theta)}} \tag{26}$$

As the droplet falls, conduction from the wall will cause the droplet to evaporate into the air. Similar to the case of a falling film, it is assumed that the temperature at the free surface of the droplet is at a saturation condition and is equal to the air temperature. From an energy balance, the conduction heat transfer through the droplet must be equal to the rate of evaporation at the droplet surface.

$$\dot{q} = \dot{m}_{eva} i_{fg} = k_w A \frac{T_{wall} - T_{sur}}{L_{eff}} \tag{27}$$

where the effective length $L_{eff}$ is approximated by the average thickness $\delta_d$ of the droplet.

$$L_{eff} \approx \delta_d = \frac{V}{A} = \frac{1}{3}\sin^2(\theta/2)[3 + \tan^2(\theta/2)]r \tag{28}$$

The speed of the droplet as it travels downwards along the radiator is governed by the momentum equation including gravity and the wall shear forces.

$$-\tau A + \rho_w V g = \rho_w V \frac{d\bar{u}_d}{dt} \tag{29}$$

where the shear stress τ is proportional to the gradient of the velocity field at the wall for a laminar flow. While the actual velocity distribution within the droplet is complex and the velocity gradient is likely to vary along the base of the droplet, the velocity gradient is on the order of the ratio of the average velocity to the average thickness.

$$\tau = \mu_w \frac{du_d}{dy} \sim \mu_w \frac{\bar{u}_d}{\delta_d} \tag{30}$$

Example Evaporative Cooling from Elongated Droplets (Case 3)

Another method of generating discrete liquid droplets, for evaporative cooling on the extended channel surfaces of the hybrid radiator, is to pass liquid through a slot in a plate. As with the semispherical drops discussed previously, elongated water droplet volume is controlled by a force balance between gravity acting on the droplet and the surface tension acting on the perimeter.

$$V = \frac{m_d}{\rho_w} = \frac{2\gamma(L + W)}{g\rho_w} \tag{32}$$

Similar to the case of the semispherical droplet, it is assumed that the elongated droplet has the form of two semispheres connected in between by a cylinder all of which have been cut by the same plane as shown in FIG. 3. The volume of the droplet can be determined from the volume sum of the semispherical ends and the cylindrical center.

$$V = \frac{\pi}{6}(3a^2 + b^2)b + \alpha r\left[r^2\cos^{-1}\left(\frac{r-b}{r}\right) - (r-b)\sqrt{2rb - b^2}\right] \tag{33}$$

The cap base radius a and the cap height b can be calculated from the same equations as those in the case of a semispherical droplet. Substituting the results into the volume equation provides the radius of the end spheres.

$$r = \sqrt[3]{\frac{3V}{\pi(2 - 3\cos\theta + \cos^3\theta) + 3\alpha(\theta - \cos\theta\sin\theta)}} \tag{3}$$

where the parameter α is the ratio of the center cylinder length to the end sphere radius. The momentum and energy equations are the same as in the semispherical drop case. However, the effective length is changed due to the new volume, shape, and contact area.

$$L_{eff} \approx \delta_d = \frac{V}{A} = \frac{1}{3}\frac{\pi(2 - 3\cos\theta + \cos^3\theta) + 3\alpha(\theta - \cos\theta\sin\theta)}{\pi\sin^2\theta + 2\alpha\sin\theta}r \tag{35}$$

Results: Heat Transfer Increases

In the first configuration (case 1) considered in this study, the heat removal rate was calculated from the radiator described previously with dimensions given in Table 1 using the same frontal area but with extended channel area for evaporative cooling. The extended length in the x direction for evaporative cooling was 20 mm. The engine speed was fixed at 1700 rpm with a 221.8-kW heat rejection rate from the radiator per Table 2, and the outside air temperature was fixed at 47° C. that is the highest temperature in a typical meteorological year for Barstow, Calif. (near Baker Grade). The heat transfer removal rate as a function of water consumption rate generated using falling liquid film evaporation is shown in FIG. 4. It is noted that, at water consumption rates of 76 L/hr (20 gal/hr) and 189 L/hr (50 gal/hr), the total heat removal rate is increased by 42 kW and 102 kW, respectively. A small part of this increase (~3 kW) is due to the increased surface area associated with the coolant channel extensions of the hybrid radiator design. The rest of the sizable increase in heat removal rate is due to evaporative cooling. At both of these flow rates, the cooling water completely evaporated before reaching the bottom of the radiator.

The total heat transfer rate increases of 19% and 46% for the radiator with liquid film evaporative cooling occurred even though there was a slight decrease in the heat transfer contribution from the finned surfaces. This decrease in finned surface heat transfer increased with the water consumption rate. This result is due to the fact that, with evaporative cooling, the coolant temperature decreases more rapidly as it flows in the channels producing a smaller temperature difference for convection from the fins. The decrease in finned surface heat transfer is seen to be small compared to the increase in evaporative heat transfer. Optimization of design parameters would maximize the sum of both heat transfer contributions (finned area and evaporation area). Parallel and series arrangements could be considered in such an effort. The configuration used in this study produced large overall heat transfer increases by favoring the evaporation contribution.

At a 76-L/hr (20-gal/hr) flow rate, the actual flow rate on each extended surface of the hybrid radiator is only 0.107 ml/s. At this low flow rate, it is difficult to maintain a continuous liquid film across the 20-mm extension since it would be only 0.11 mm in thickness. Additionally, falling films have a tendency to break up into rivulets or droplets such as streaks. Therefore, an analysis was performed with the evaporating liquid film replaced by evaporating discrete droplets falling downwards along the extended radiator channel surfaces. The size of the droplets was determined by the exit diameter of a source hole. The shape of the droplets on the vertical surfaces was approximated by taking into account the contact angle. The percentage of evaporation of each droplet from a circular hole is plotted in FIG. 5 along with the contact angle and the circular hole diameter. For 100% evaporation, the amount of additional heat transfer using the droplets is similar to that using the falling film. For less than 100% evaporation, the additional heat transfer calculated using the falling film should be multiplied by the evaporation percentage to obtain the actual heat transfer using the droplets.

In order for the water to be used efficiently for evaporative cooling, the contact angle between the water and the surface needs to be below 25 degrees, and the source hole diameter needs to be as small as possible. There are many techniques to lower the contact angle between a liquid and a surface. One study showed the contact angle between water and aluminum being reduced to 3 degrees using a plasma surface treatment on aluminum. Interestingly, the present analysis showed that the thickness of the droplets from the surfaces is the most important parameter in governing both the evaporation rate of the droplets and the speed at which the droplets travel downwards along the surfaces. FIG. 6 shows droplet evaporation percentage traveling downwards along a vertical surface for various source hole diameters. Droplets that had a larger initial thickness, i.e. height from the surface, stayed on the radiator channels for a shorter period of time and consequently had less evaporation. Droplets with a small initial height (less than 0.2 mm) were able to stay on the surface until they completely evaporated. Because of its importance on the evaporation rate, the average initial thickness of the droplet is given in FIG. 7 as a function of the contact angle and the hole size.

A similar analysis was performed with an evaporating liquid film replaced by evaporating discrete volumes from a slot-shaped hole (15 mm×0.1 mm). It was originally thought that a wider-shaped volume coming out from the source hole would create the potential for a more film-like water shape. Unfortunately, having the slot-shaped source holes instead of circular holes formed a larger contact perimeter for surface tension and made the volume and therefore the thickness of each droplet too large before detaching from the source hole. This larger thickness, >0.34 mm even for the best combination of the contact angle and the slot dimensions analyzed, resulted in higher velocities downwards along the radiator and lower droplet evaporation percentages.

In summary, adding evaporative cooling to the existing radiator can increase the heat transfer from the radiator by an additional 42 kW or 102 kW for a cooling water flow rate of 76 L/hr (20 gal/hr) or 189 L/hr (50 gal/hr), respectively. Evaporative cooling as a falling film may have some difficulties due to the low flow rates and the thin film thicknesses required. However, by using droplets from small holes and by adjusting the contact angle between the droplet and the surface through surface treatment, the potential of evaporative cooling to increase heat transfer from the same sized radiator can be realized.

Results: Radiator Size Reductions

The results presented above essentially considered increasing the heat transfer rate from an existing radiator. Alternatively, it may be desirable for the engine to stay the same size but with a reduced sized radiator. Thus, in the second configuration considered in this study, radiator size reduction possibilities were calculated utilizing evaporative cooling. The two conditions of the engine speed of 1700 rpm with a 221.8-kW heat rejection rate and the outside air temperature of 47° C. were unchanged. The reduction in radiator size is in the form of a reduced width from the original size given in Table 1. The results for the radiator width as a function of the water consumption rate, calculated from a thin falling film similar to the first study, are shown in FIG. 8. The original width of the radiator in this study was 988 mm. It is noted that, at water consumption rates of 76 L/hr (20 gal/hr) and 189 L/hr (50 gal/hr), the width could be reduced to 778 mm and 478 mm, respectively, which corresponds to radiator area decreases of 21% and 52%, respectively. In each case studied, the film was assumed to completely evaporate before reaching the bottom of the radiator. Using droplets instead of a film will give the same potential for area reduction as long as the droplets completely evaporate. Thus, an average thickness of 0.2 mm for an initial droplet would be necessary to see the full potential in area reduction. It is also noteworthy to mention that if the frontal area of the tractor were modified to account for the reduced radiator size that can be achieved by the hybrid cooling system, aerodynamic drag would also be reduced, thereby increasing fuel efficiency.

The design condition for truck and automobile radiators usually is the most severe condition possible: the highest air temperature and the steepest grade. Many vehicles may never encounter such conditions found at places such as Baker Grade in California or Union Pass in Arizona in a hot summer afternoon. A good potential utilization of evaporative cooling is to size the finned portion of the radiator for an alternative design condition corresponding to a steep grade away from the desert hills. Thus, water for evaporative cooling would be needed only when a vehicle travels through the desert hills under extremely hot conditions. An 11-kilometer (7-mile)

stretch of land along Interstate Highway 24 near Monteagle, Tenn. is an example of a steep grade that could be used for the alternative design condition for the finned portion of the radiator. According to the typical meteorological year for Chattanooga, Tenn. near Monteagle, the highest temperature can reach 37° C. If the radiator were sized at this location with the same coolant temperatures and heat transfer rates, then the radiator could be 22% smaller in width compared to the Baker grade design condition. Thus, on the majority of roads in the United States, the smaller radiator would be sufficient. Under conditions of 47° C. and constant full engine power for a long period of time, the water flow rate of approximately 76 L/hr (20 gal/hr) would be needed to remove the remainder of the heat. Since it takes less than one hour to traverse 40-kilometer (25-mile) Baker Grade and 48-kilometer (30-mile) Union Pass, the amount of water consumed would be less than 76 liters (20 gallons) for either of them with this example design modification.

CONCLUSIONS

Coolant radiators in trucks and automobiles were shown to be amenable to evaporative cooling. Using a hybrid truck radiator, 19% and 46% heat transfer increases were obtained with 76-L/hr (20-gal/hr) and 189-L/hr (50-gal/hr) water flow rates, respectively. These results were dependent on the establishment of water flow with small thickness from the radiator surfaces. It was found that such thickness could readily be obtained by using droplet flow with contact angle management.

An alternative to the heat transfer increase from an existing radiator with the addition of evaporative cooling is radiator size reduction. It was shown that, at the design heat load, the 76-L/hr (20-gal/hr) and 189-L/hr (50-gal/hr) water flow rates yield radiator area reductions of 21% and 52%, respectively.

A good potential utilization of evaporative cooling considered wherein the finned portion of the radiator was designed to accommodate all driving conditions except for desert hills. In this case, water for evaporative cooling would only be needed when a vehicle travels through desert hills under extremely hot conditions. It was found that the radiator area could be reduced by 22% when only 76 liters (20 gallons) of water were used to traverse an extreme desert hill such as Baker grade.

While the present invention has been described with reference to the details of the embodiments of the invention shown in the drawings, these details are not intended to limit the scope of the invention as claimed in the appended claims.

What is claimed is:

1. A hybrid radiator-cooling apparatus for implementing enhanced radiator-cooling comprising:

an air-side finned surface for air cooling;

an elongated vertically extending surface extending outwardly from said air-side finned surface on a downstream air-side of the hybrid radiator; and a water supply for selectively providing evaporative cooling with water flow by gravity on said elongated vertically extending surface.

2. The hybrid radiator-cooling apparatus as recited in claim 1 includes a plurality of generally rectangular tubes defining a plurality of said elongated vertically extending surfaces extending outwardly from the air-side finned surface.

3. The hybrid radiator-cooling apparatus as recited in claim 1 wherein said water supply providing water droplets falling by gravity on said elongated vertically extending surface for evaporative cooling.

4. The hybrid radiator-cooling apparatus as recited in claim 1 wherein said water supply for selectively providing evaporative cooling with water flow by gravity on said elongated vertically extending surface responsive to a predefined thermal design condition for the radiator-cooling system.

5. The hybrid radiator-cooling apparatus as recited in claim 1 wherein said air-side finned surface for air cooling having a predefined size for air cooling to remove required engine heat under general driving conditions.

6. The hybrid radiator-cooling apparatus as recited in claim 1 wherein water supply for selectively providing evaporative cooling with water flow by gravity on said elongated vertically extending surface responsive to a predefined high heat load on an engine.

7. The hybrid radiator-cooling apparatus as recited in claim 1 includes a plurality of generally flat rectangular tubes for defining a plurality of said elongated vertically extending surfaces extending outwardly from the air-side finned surface having a selected area for evaporative cooling.

8. The hybrid radiator-cooling apparatus as recited in claim 7 wherein said water supply for selectively providing evaporative cooling with water flow by gravity on said elongated vertically extending surface includes said water supply providing water droplets falling by gravity on said elongated vertically extending surfaces for evaporative cooling.

* * * * *